US010934803B2

(12) United States Patent
Zeng

(10) Patent No.: US 10,934,803 B2
(45) Date of Patent: Mar. 2, 2021

(54) BALL SEAT

(71) Applicant: VERTECHS OIL & GAS TECHNOLOGY CO., LTD., Chengdu (CN)

(72) Inventor: Qijun Zeng, Chengdu (CN)

(73) Assignee: VERTECHS OIL & GAS TECHNOLOGY CO., LTD., Chengdu (CN)

( * ) Notice: Subject to any disclaimer, the term of this patent is extended or adjusted under 35 U.S.C. 154(b) by 295 days.

(21) Appl. No.: 16/079,564

(22) PCT Filed: Aug. 22, 2018

(86) PCT No.: PCT/CN2018/101649
§ 371 (c)(1),
(2) Date: Aug. 24, 2018

(87) PCT Pub. No.: WO2020/037528
PCT Pub. Date: Feb. 27, 2020

(65) Prior Publication Data

US 2020/0291739 A1 Sep. 17, 2020

(51) Int. Cl.
*E21B 33/129* (2006.01)

(52) U.S. Cl.
CPC ..... *E21B 33/1293* (2013.01); *E21B 2200/08* (2020.05)

(58) Field of Classification Search
CPC ..... E21B 33/12; E21B 33/129; E21B 33/1293
See application file for complete search history.

(56) References Cited

U.S. PATENT DOCUMENTS

| | | | | |
|---|---|---|---|---|
| 5,343,946 | A * | 9/1994 | Morrill | E21B 33/1216 166/148 |
| 2016/0108700 | A1 | 4/2016 | Halfmann et al. | |
| 2016/0186511 | A1* | 6/2016 | Coronado | E21B 33/129 166/381 |
| 2018/0328137 | A1* | 11/2018 | Smith | E21B 33/128 |
| 2020/0157914 | A1* | 5/2020 | Graham | E21B 33/134 |

FOREIGN PATENT DOCUMENTS

| | | |
|---|---|---|
| CN | 2481843 Y | 3/2002 |
| CN | 207538786 U | 6/2018 |
| CN | 207554014 U | 6/2018 |

* cited by examiner

*Primary Examiner* — David J Bagnell
*Assistant Examiner* — Yanick A Akaragwe
(74) *Attorney, Agent, or Firm* — Bayramoglu Law Offices LLC

(57) ABSTRACT

A ball seat configured for multistage stimulation in oil and gas wells includes bottom sub, slips, sealing element and mandrel. The mandrel is a cone frustum, and it's exterior is encased by the sealing element and slips. One end of the sealing element is attached to one end of slip, the end of the cone frustum mandrel with the smallest exterior diameter is completely encased by slips. One end of the bottom sub is attached the other end of the slip. The bottom sub includes a threaded shearing connecting structure, which is designed to connect the setting tool adaptor used to deploy the ball seat into the oil or gas well. The sealing element is a two-segment structure, the hardness of the first segment is lower than that of the second segment.

16 Claims, 8 Drawing Sheets

BALL SEAT

CROSS REFERENCE TO RELATED APPLICATIONS

This application is the national phase entry of International Application PCT/CN2018/101649, filed on Aug. 22, 2018, the entire contents of which are incorporated herein by reference.

TECHNICAL FIELD

This invention relates to the technical field of downhole completion tool, and particularly to a kind of ball seat used for the multistage stimulation of oil and gas wells.

BACKGROUND

In the operation of multistage stimulation of oil and gas wells, the composite plugs or cast iron plugs are commonly used as the tool for zonal isolation.

For the well running composite plugs, all plugs must be drilled out by coiled tubing to achieve full-bore access after the stimulation operation is completed. However, drilling out is time-consuming due to the limitation of the materials and the long lateral sections of oil and gas wells.

The cast iron plugs used in the multistage stimulation operation is usually with large inner diameter. It allows flow back directly and put the well into production after the stimulation is completed and it saves operation time substantially. With the production decline of the oil and gas wells in years. Refrac (repeat the stimulation carried out on the well previously) of the oil and gas wells has become an important mean of increasing the production of oil and gas wells. However, the cast iron plugs in well limit the passage of wellbore re-entry and the methods of Refrac.

SUMMARY

The technical problem to be solved by this invention is: To increase the hermeticity of the ball seat.

In order to resolve the technical problem above, this invention provides a kind of ball seat used for the multistage stimulation of the oil and gas wells; which includes bottom sub, slips, sealing element and mandrel; the mandrel has the shape of cone frustum, and a seat for ball landing and sealing element is set at the mandrel from the end with larger external diameter; the sealing element and the slips are muff-coupled on the outside of the end of the mandrel from the end with smaller diameter, along with the direction of decreasing external diameter of the mandrel respectively; one end of the sealing element is attached to one end of the slips, and the end of the mandrel with smaller external diameter is situated in the slips; one end of the bottom sub is attached the other end of the slips, and a connecting structure is located in the bottom sub for connecting setting tool adaptor; the sealing element has a two-segment structure in the axial direction, the first segment of the sealing element is packed at the end of the mandrel with larger external diameter, and the second segment of the sealing element is located at the end of the mandrel with smaller external diameter; the hardness of the sealing element of the first segment is smaller than the second segment; the first segment of the sealing element clamps with the second segment of the sealing element mutually.

The beneficial effect of this invention: since the hardness of the first segment of the sealing element is low, and the first segment of the sealing element is situated at the end of the mandrel with larger external diameter, such sealing element tends to expand, and the initial sealing can be easily to be formed; at the same time, the hardness of the second segment of the sealing element is higher, and the flexibility of the rubber sleeve is reduced, the pressure-bearing effect of the sealing element is enhanced, and thus, the hermeticity can be warranted.

Further, the boss is located on the mandrel circumference with larger external diameter, the boss and the external surface of the mandrel with smaller external diameter forms a transformational slope; after the ball seat has been sealed, the other end of the sealing element will cover the transformational slope.

The beneficial effect of above is that: since the boss is located on the mandrel circumference with larger external diameter, and the boss forms a transformational slope with the exterior of the mandrel with smaller external diameter; during the setting process of the ball seat, the slips will push the sealing element to force the first sealing element move towards the larger external diameter of mandrel along the transformational slope, which causes the first sealing element to extrude and expand rapidly, therefore, making contact with the interior casing wall to form initial sealing; after initial sealing of the first sealing element, the second sealing element extrudes and forcing against the slips; the position and space for elastic recovery at both ends has been restricted, therefore, sealing element cannot recover elastically, thus, the sealing effect can be persistent and the hermeticity can be ensured.

In addition, the boss extends on the axial direction of the mandrel to the end of the mandrel with larger external diameter.

The beneficial effect of above is that: the boss and the end of the mandrel with larger external diameter will form a single-piece structure.

Further, the surface of the slips are made of multi-layered frictional structure.

The beneficial effect of above is that: since conventional slip structure consists slip tooth which are used for anchoring effect within the casing walls of oil and gas wells, the structure and assembling process of such tooth are very complexed and time consuming, and the anchoring effects are not very reliable, since the anchoring force is only applied to the tooth instead of the whole slip structure. By using multi-layered frictional structure, anchoring effects are increased significantly within the casing of oil and gas wells.

In addition, the axial upward direction of the slips has many socket structures, and all of the sockets are distributed evenly on the circumference of the slips.

The beneficial effect of above is that: there are many socket structure evenly distributed on the axial upward direction of the slips, and during the sealing procedure, the slips extrude and expand by moving towards the larger external diameter of mandrel, and large stress is generated on the socket structure during this process, the stress causes the socket structure to crack into uniformed size, and forcing the slips anchor into the interior casing wall. The anchoring force of the slips of the entire ball seat towards the circumference direction is also consistent, therefore, the pressure-bearing capability of the entire ball seat is increased and the hermeticity can be ensured.

Further, the Moh's hardness of the multi-layered frictional structure is larger or equals to 3.

The beneficial effect of above is that: by using high hardness frictional particles on the slips surface directly to make the frictional layer and the slips to form a single-piece structure, therefore, increasing the reliability and integrity of the frictional layer and slips.

Further, the length of the sealing element in the axial direction and the length of the slips on the axial direction have the length ratio relation of 2:5 to 3:5.

The beneficial effect of above is that: for a single-slip structure ball seat, since pressure-bearing sealing element has elastic recovered stress, by setting the ratio of the length of the sealing element on the axial direction and the length of the slips on the axial direction to 2:5 to 3:5, the anchoring capability and hermeticity of the slips of the ball seat can be optimized.

Further, the baffle ring is set between the sealing element and the slips, the baffle ring is attached to the sealing element and the slips respectively, the internal diameter of the baffle ring matches the external diameter of the mandrel.

The beneficial effect of above is that: During the setting process of the ball seat, the sealing element on the mandrel with larger external diameter will bear larger pressure; by using baffle ring, it prevents the sealing element from deforming caused by high pressure, therefore, the pressure-bearing capability and sealing performance of the entire ball seat can be increased.

Further, the baffle ring has multi-layer structure on the axial direction

The beneficial effect of above is that: the baffle ring will endure high extrusion pressure during the setting process. If the pressure is too high, the baffle ring could crack; by using multi-layered structure, when the outer baffle ring near the sealing element cracks, the mid-section of the baffle ring could still maintain space limiting and pressure bearing properly.

Further, an internal threaded structure is used to connect the setting tool.

The beneficial effect of above is that: to connect the setting tool adaptor with the bottom sub via threaded structure, during the setting process, the pushing force of the setting tool adaptor on the bottom sub is consistent and extrusion effect is outstanding; by completing the setting process, the setting tool adaptor should be detached from the bottom sub, in this case, the thread of the threaded structure can be sheared directly, so the setting tool adaptor can be detached from the bottom sub. The shearing force can be easily controlled by adjusting the thread type and thread quantity.

Further, the external diameter of the sealing element is larger than the external diameter of the slips.

The beneficial effect of above is that: since the external diameter of the sealing element is larger than the slips, during the setting process, the surface of the sealing element will extrude to make contact with the interior casing wall while being pushed by the slips from below towards the larger external diameter of the mandrel, therefore, sealing and anchoring process are synchronized.

Further, the ratio of the external diameter of the sealing element and the external diameter of the slips lies between 1.04 and 1.08

The beneficial effect of above is that: by setting the ratio of the external diameter of the sealing element and the external diameter of the slips as value above, the anchoring effect of the slips and the sealing performance of the sealing element can be the optimized.

Further, The slips, the bottom sub, the sealing element, the mandrel and the baffle ring are totally made up of dissolvable materials.

The beneficial effect of above is that: expect the slips, the entire ball seat is made up of dissolvable materials, thus, only a very small amount of residue is left in the wellbore, and the milling operation in later period is not required.

BRIEF DESCRIPTION OF THE DRAWINGS

The above and/or attached advantages of this invention is obvious and easy to understand from the description of the given example with combination of the following attached figures, in which:

In FIG. 1:

01, bottom sub; 011, connecting structure for setting tool adaptors; 02, slips, 021, frictional layer, 022, socket structure, 03, baffle ring; 04, sealing element, 041, first sealing segment, 042, second sealing segment; 05, mandrel, 051, boss, 052, transformational slope; 06, setting tool adaptor; 07, casing.

DETAILED DESCRIPTION

In order to understand the intentions, features and advantages of this invention more clearly, the following text will make a further and detailed description to this invention, combining with the attached figures and the implementing method. It should be noted that, under the condition of no conflicts, the examples and the features of the examples in this application can be mutually combined.

Figure 1:
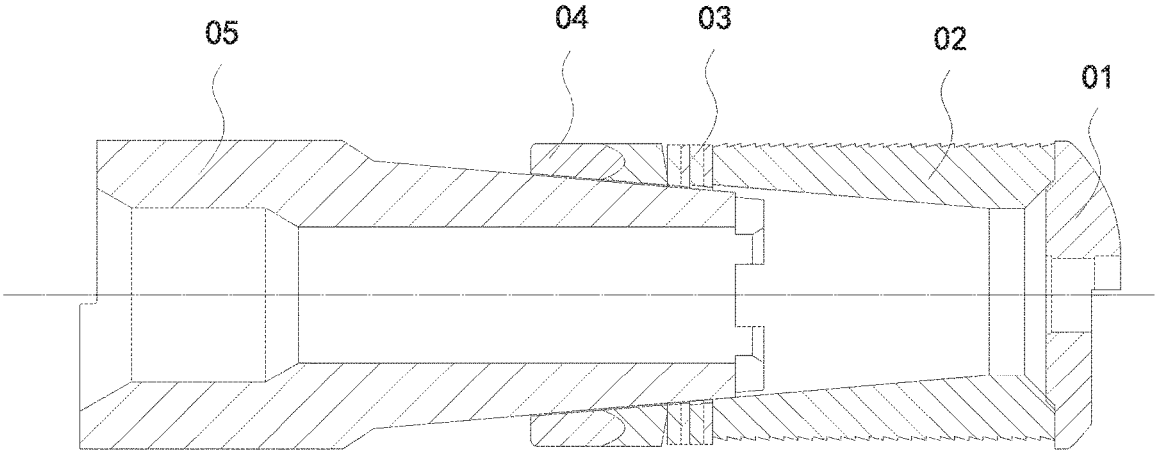
FIG. 1 is the section view of the ball seat of this invention.
Figure 2:
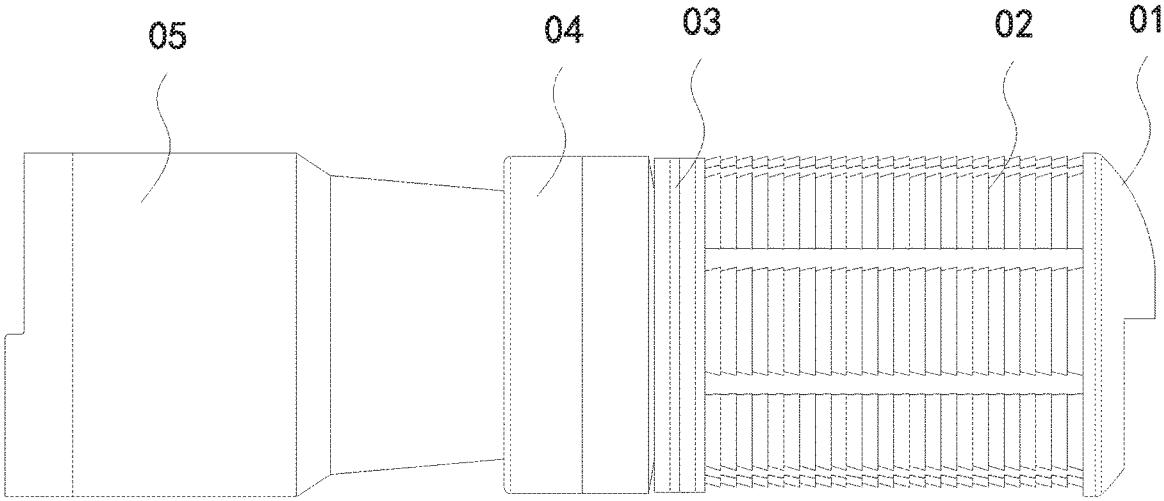
FIG. 2 is the sketch of the external structure of the ball seat of this invention.

The section view and the sketch of the external structure of this example are seen in FIG. 1 and FIG. 2. This example provides a kind of ball seat used in the multistage stimulation of oil and gas wells, including bottom sub 01, slips 02, sealing element 04 and mandrel 05. The mandrel 05 has a shape of cone frustum, and the end of the mandrel 05 with the larger external diameter has a ball landing seat; the sealing element 04 and the slips 02 are muff-coupled on the end of the mandrel 05 with larger external diameter in the direction of the decreasing external direction respectively; one end of the sealing element 04 is attached to the other end of the slips 02, the end of the mandrel 05 with the smaller external diameter is encased in the slips 02; one end of the bottom sub 01 is attached to the other end of the slips 02, and in the bottom sub 01 there is the threaded connecting structure for the setting tool adaptor 011; the sealing element has a two-segment structure in the axial direction, and the segment of the sealing element at the mandrel with larger external diameter is the first segment 041, the segment of the sealing element at the mandrel with smaller external diameter is the second segment 042; the hardness of the sealing element of the first segment 041 is lower than the hardness of the sealing element of the second segment 042; the sealing element of the first segment 041 and the sealing element of the second segment 042 is clamped mutually. The boss 051 sets on the circumference of the mandrel 05 with the larger external diameter, the boss and the external surface of the mandrel with smaller external diameter forms the transformational slope 052; there is a baffle ring 03 set between the sealing element 04 and the slips 02, the baffle ring 03 is attached to the sealing element 04 and slips 02 respectively, and the internal diameter of the baffle ring 03 matches the external diameter of the mandrel 05.

Since the hardness of the sealing element of the first segment 041 is low, and the sealing element of the first segment 041 is located at the mandrel 05 with larger external diameter, such sealing elements tends to expand, and the initial sealing is easily to formed; at the same time, the hardness of the sealing element of the second segment 042 is very high, and the flexibility of the rubber sleeve is reduced, the pressure-bearing effect of the sealing element is increased, the reliability of sealing is warranted and the seat setting force will not be affected; it is able to endure setting force between 15-18 tons.

Among current ball seats, when the pressure reaches 10 Mpa, leakage tend to occur between the sealing element and the interior casing wall, the primary cause is that the performance of initial sealing is unsatisfactory. In this example, the boss 051 sets on the circumference of the mandrel 05 with larger external diameter, the boss 051 and the external surface of the mandrel with smaller external diameter forms a transformational slope 052. During setting process of the ball seat, the slips push the sealing element, to make the first sealing element 041 move towards the mandrel 05 with the larger diameter. When the first sealing element 041 reaches the transformational slope 052, the increasing in diameter of the mandrel caused the first sealing element to extrude and expand rapidly, and the initial sealing is formed after the sealing element contacts the interior casing wall. When the setting process of the ball seat is completed, the first sealing element 041 extrudes and covers the transformational slope 052, and the second sealing element 042 extrudes and pushed against by the slips 02; the position and space for elastic recovery at both ends has been restricted, therefore, sealing element cannot recover elastically, thus, the sealing effect can be persistent and the hermeticity can be ensured.

During the setting process of the ball seat, by connecting the setting tool adaptor 06 to the bottom sub 01, the ball seat will be placed in the casing and intend to reach the designated location. The setting tool adaptor 06 pulls the bottom sub 01 upwards, and it also push the mandrel 05 downwards, i.e., push the mandrel of the ball seat 05 to move downwards so as to make the relative movement between the mandrel 05 and bottom sub 01. At the same time, the sealing element 04 and baffle ring 03 will undergo elastic deformation due to extrusion, which makes the sealing element 04 contact with the interior casing wall 07 to form seal; the slips 02 will crack and be anchored into the interior casing wall, when the pushing force of the setting tool adaptor reaches the certain value, the setting tool adaptor and the bottom sub 01 will detach and the setting tool adaptor will be retrieved. At the same time, the slips 02 will anchor into the interior casing wall via frictional layered surface 021, and the ball seat setting is completed.

Figure 3:
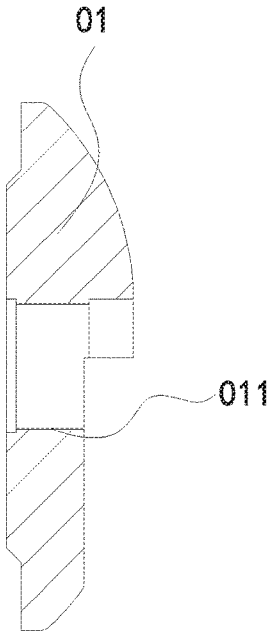
FIG. 3 is the section view of the bottom sub of this invention.
Figure 4:
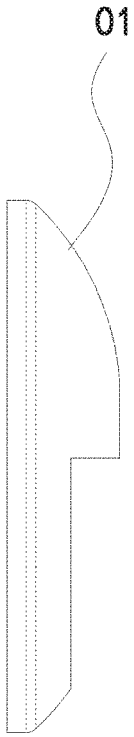
FIG. 4 is the sketch of the external structure of the bottom sub of this invention.

The section view of this example and the sketch of the external structure are seen in FIG. 3 and FIG. 4; at the junction the bottom sub 01 and the slips 02 there is a projecting structure of the internal cavity of slips 02, which is convenient for restricting the bottom sub 02 and the slips 02 on the corresponding locations in the circumference direction, so as to ensure the slips 02 is forced evenly during the sealing procedure. At the same time, the threaded connecting structure 011 of the setting tool adaptor is in the hollow cavity of the bottom sub 01.

Connect the bottom sub 01 to the setting tool adaptor via the threaded structure 011; during extrusion and sealing, the pushing force of the setting tool adaptor 06 on the bottom sub 01 is consistent, the extrusion effect is outstanding; when the sealing is completed, the setting tool adaptor 06 should be detached from the bottom sub 01. The thread of the connecting structure will be sheared off directly, and the setting tool adaptor will be reliably detached from the bottom sub 01. The shearing force on the circumference direction is balanced and it is very easy to control.

Figure 5:
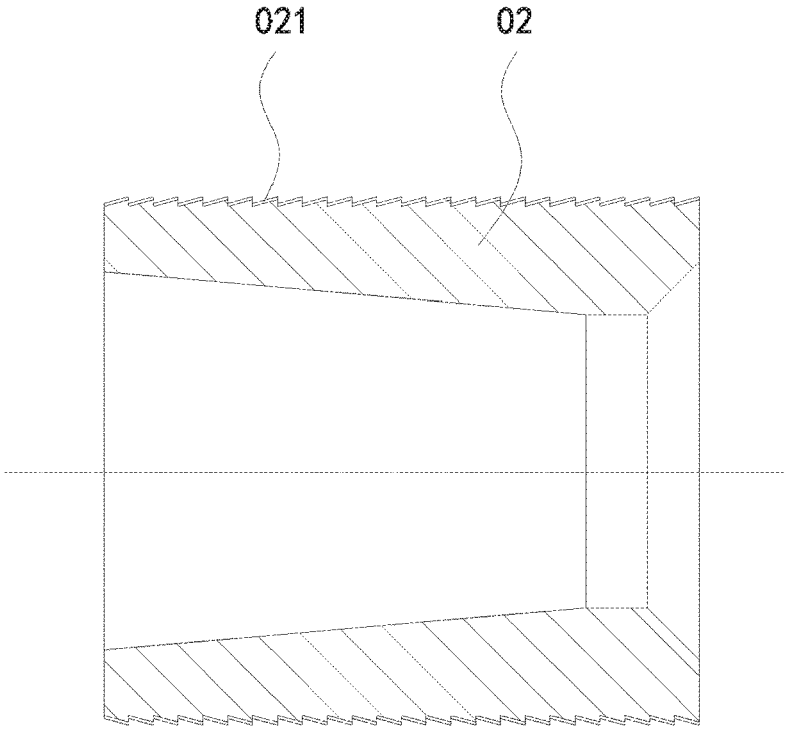
FIG. 5 is the section view of the slips of this invention.
Figure 6:
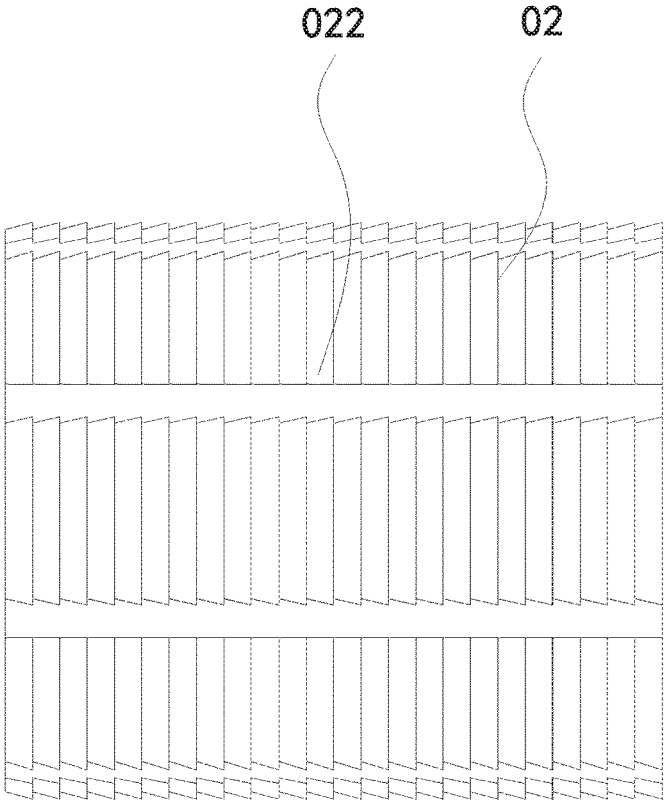
FIG. 6 is the sketch of the external structure of the slips of this invention.

The section view of the slips 02 and the sketch of the external structure is shown in FIG. 5 and FIG. 6. There is a frictional layer 021 set on the surface of the slips 02, and the frictional layer 021 has a multi-layered structure and there are 8 socket structure 022 on the circumference direction of the slips 02, all the eight sockets are evenly distributed among the circumference direction of the slips 02. In which, the Moh's hardness of the frictional layer 021 is larger or equals to 3. In this example, the frictional layer 021 has a five-layered structure, and the frictional layer 021 is fixed on the surface of the slips 02 by sintering under high temperature. The frictional layer 021 in this example is made of metal particles with the diameter of 5-100 mesh.

Since conventional slip structure 02 consists slip tooth which are used for anchoring effect within the casing walls of oil and gas wells, the structure and assembling process of such tooth are very complexed and time consuming, and the anchoring effects are not very reliable, since the anchoring force is only applied to the tooth instead of the whole slip structure 02. By using multi-layered frictional structure 021, anchoring effects are increased significantly within the casing of oil and gas wells.

There are 8 socket structures 022 evenly distributed on the circumference direction of the slips 02, and during the setting, the slips 02 will be extruded and expand along the increment external diameter of the mandrel 05, and it will generate large stress in the socket structure 022 and the slips 02 will crack at the socket structure 022 to make the slips 02 anchor into the interior casing wall; the evenly distributed socket structure 022 makes the cracked slips 02 evenly in size. It increases the pressure-bearing capability of the entire ball seat as well as the reliability of the ball seat setting. In this example the socket structure 022 has the depth of 4 mm, and the socket structure 022 has the width of 4 mm, so as to ensure that the slips 02 is easily cracked.

In the product application, we can adjust the number of sockets by 4, 6 or 12 on the socket structures 022 according to the environment and condition of the product which is applied; the width and depth of the socket can also be adjusted to 5 mm or 6 mm, etc. In which, the frictional layer 021 can also be placed on the surface of the slips 02 by sputtering or affixation.

Figure 7:
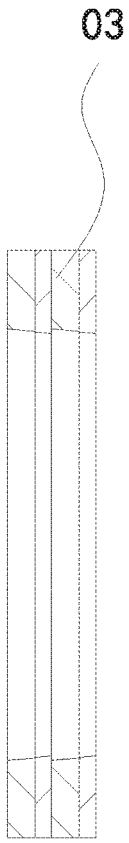
FIG. 7 is the section view of the baffle ring of this invention.
Figure 8:
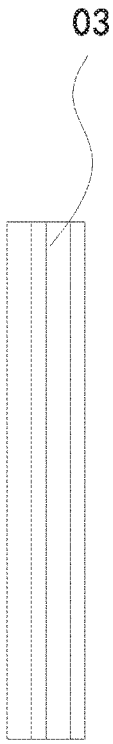
FIG. 8 is the sketch of the external structure of the baffle ring of this invention.

The section view and the sketch of the external structure of the baffle ring in this example are shown in FIG. 7 and FIG. 8. The baffle ring 03 has four layers, the thick layers and thin layers are placed alternatively. The mandrel with larger external diameter is set with ball landing seat for sealing, also the mandrel 05 with larger external diameter will bear high pressure. The direction of the pressure is applied from the mandrel 05 with larger external diameter to the mandrel 05 with smaller external diameter, and the end of the sealing element towards the larger external diameter of the mandrel 05 will bear high pressure; by setting the baffle ring 03, it can prevent the end of the sealing element 04 from deforming under high pressure, and the pressure-bearing capability and sealing performance of the entire ball seat will be increased. By using a four-layered structure, when the outer baffle ring of the sealing element 04 cracks, the middle baffle ring will not crack and it can limit the spacing and bear pressure properly.

The baffle ring 03 in this example is made of dissolvable material with the Moh's hardness no less than 3, so as to ensure the capability of pressure-bearing of the baffle ring 03 when it is being extruded.

Figure 9:
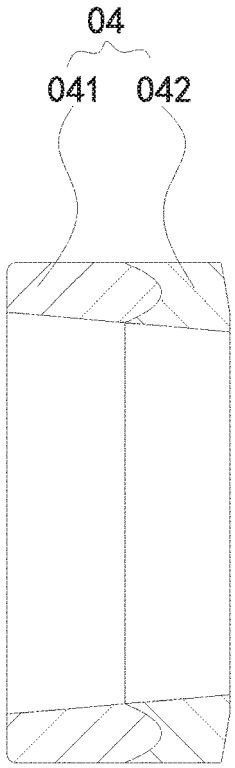
FIG. 9 is the section view of the sealing element of this invention.
Figure 10:
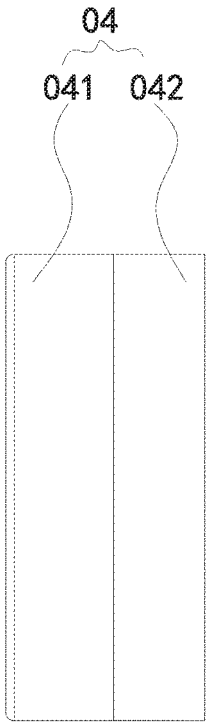
FIG. 10 is the sketch of the external structure of the sealing element of this invention.

The section view and sketch of the external structure of the sealing element 04 in this example are shown in the FIGS. 9 and 10. The sealing element 04 has a two-segment structure in axial direction, and the segment of the seal element on the mandrel 05 with larger external diameter is the first segment 041, and the segment of seal element at the mandrel 05 with the smaller external diameter is the second segment 042. The hardness of the first segment 041 is lower than the second segment 042, the first segment 041 and the second segment 042 is clamped mutually.

Figure 11:
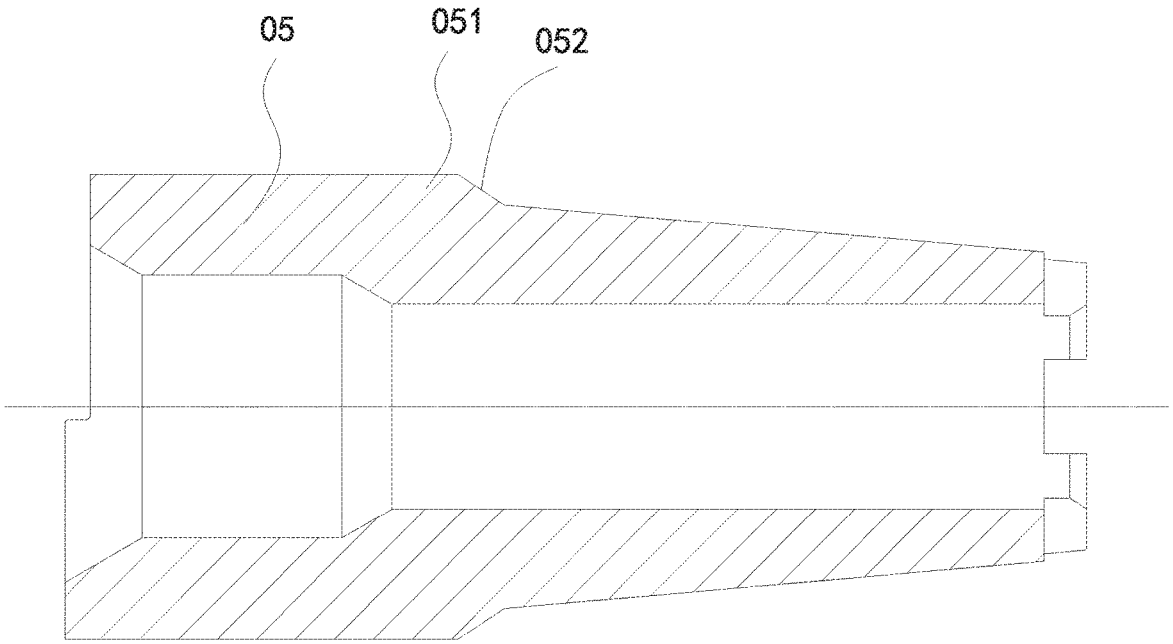
FIG. 11 is the section view of the mandrel of this invention.
Figure 12:
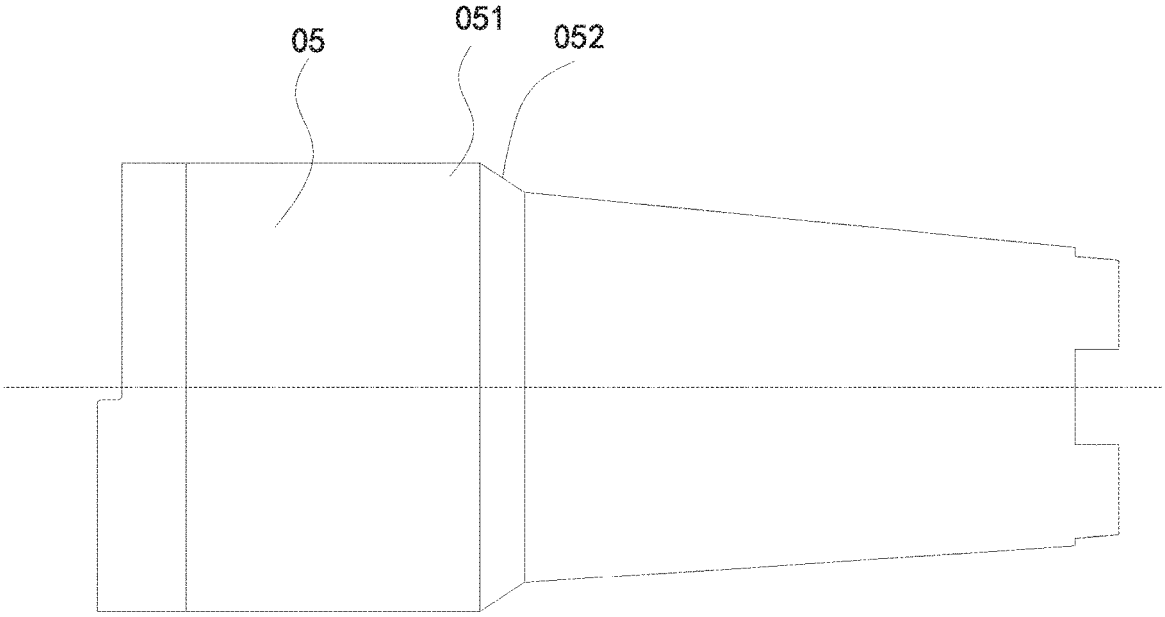
FIG. 12 is the sketch of the external structure of the mandrel of this invention.

The section view and sketch of the external structure of the mandrel 05 in this example are shown in the FIGS. 11 and 12. The external diameter of the mandrel 05 is large and it has the shape of a cylinder structure; one end of the mandrel 05 with larger external diameter and the other end of the mandrel 05 with smaller diameter forms the boss 051; the boss 051 extends to the end of the mandrel with larger external diameter at the axial direction of the mandrel 05, and it forms a single-piece structure at the end of the mandrel 05 with larger external diameter; the boss 051 and the external surface of the mandrel with smaller external diameter form the transformational slope 052. When the ball seat has been sealed, the other end of the sealing element 04 is extruded and covers on the transformational slope, and it is situated at the external cylinder surface of the cylinder structure. Because the hardness of the sealing element of the first segment 041 is very low, such sealing element is easily expanded and the initial sealing is easily formed. At the same time, the hardness of the sealing element of the second segment is high, the flexibility of the rubber sleeve is reduced, the pressure-bearing effect of the sealing element is increased, and the hermeticity is also ensured.

Because the boss 051 is set on the circumference direction on the mandrel 05 with larger external diameter, the boss 051 and the external surface of the mandrel 05 will smaller diameter will form the transformational slope 052. During the setting process of the ball seat, the slips push the sealing element and make the first sealing segment 041 move towards the mandrel 05 with larger external diameter. When the first sealing segment reaches the transformational slope 052, since the external diameter of the mandrel 05 is larger, it causes the first sealing segment 041 to extrude and expand rapidly, and the sealing element will make contact with the interior casing wall and form the initial sealing. The overall height of boss 051 in this example is 5 mm, and the conical degree of the mandrel 05 is 15, the external diameter of the mandrel 05 matches the internal diameter of the slips 02.

In the application, the height of the boss 051 can be adjusted at any value between 2 mm and 6 mm, and it can also be set as an intermittent circular structure. The conical degree of the mandrel 05 can be adjusted from 10 to 18 accordingly.

In this example, the length of the sealing element 04 in the axial direction and the length of the slips 02 in the axial direction has a ratio of 1:2. For the ball seat with single slips structure 02, since the extruded elastic sealing element 04 has elastic recovery pressure, by setting the length ratio of the sealing element 04 on the axial direction and the length of the slips 02 in the axial direction to 1:2, so as to ensure the anchoring capability of the slips of ball seat 02 and the hermeticity can be optimal.

In the application, we can properly select the length ratio of the sealing element 04 to the slips 02, so as to achieve optimal combination.

In this example, the external diameter of the sealing element 04 is larger than the slips 02, in which, the ratio of the external diameter of the sealing element 04 to the slips 02 is 1.05. During the setting process, the surface of the sealing element 04 will extrude to make contact with the interior casing wall 07 while being pushed by the slips 02 from below towards the larger external diameter of the mandrel 05, therefore, sealing and anchoring process are synchronized.

In this example, the slips 02, bottom sub 01, sealing element 04, mandrel 05 and baffle ring 03 are made up of Mg—Al alloy dissolvable material.

Figure 13:
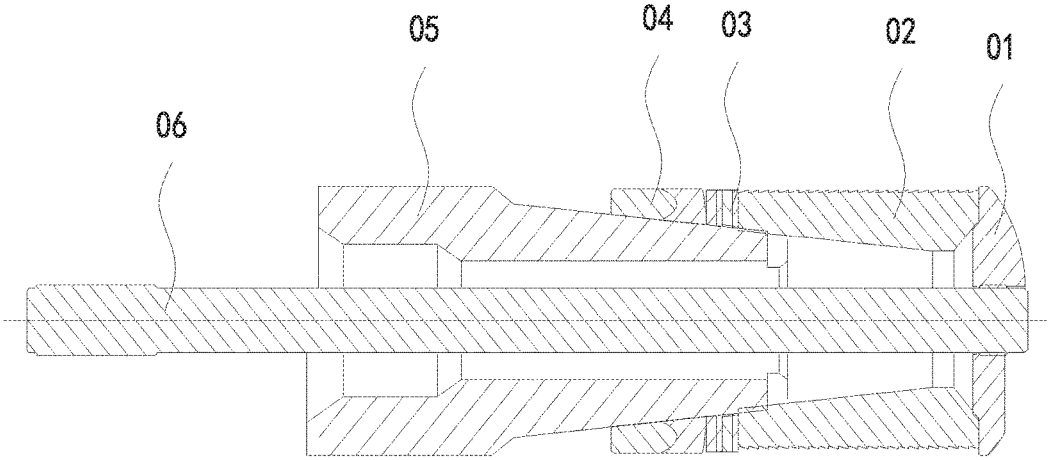
FIG. 13 is the section view of the setting tool adaptors of this invention.

The section view of the setting tool adaptor 06 in this example is shown in the FIG. 13, the setting tool adaptor connects to the bottom sub 01 via the thread, it is convenient for transportation and product application; at the same time, consistent pushing force of the bottom sub 01 can be achieved by thread shearing.

Figure 14:
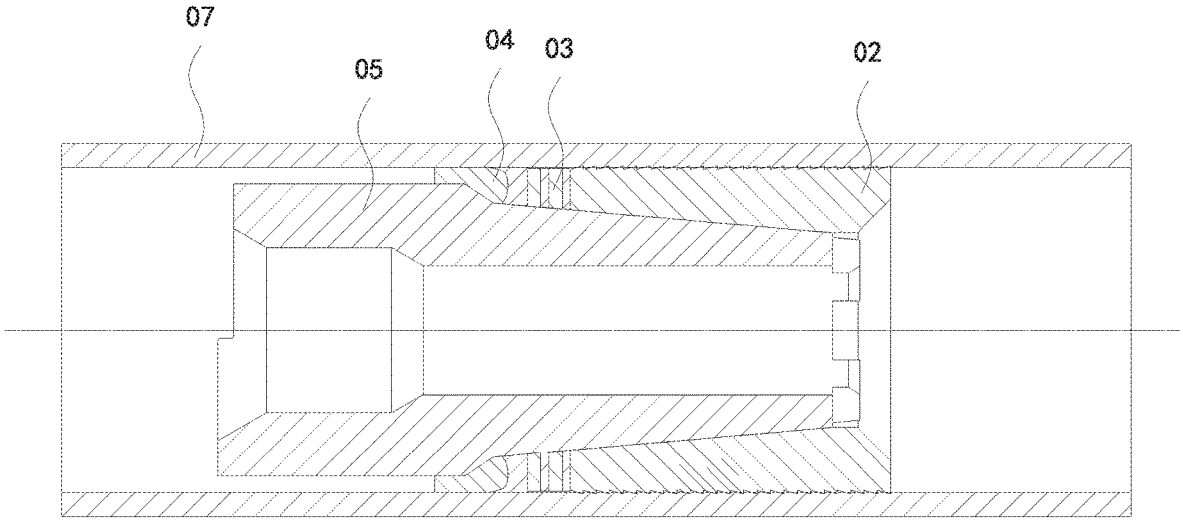
FIG. 14 is the section view of the completed seat sealing of this invention.

The section view of the completed ball seat setting in the casing 07 is shown in FIG. 14. During the setting process, by connecting the setting tool adaptor 06 with the bottom sub 01, the ball seat can be placed in the casing 07 and reach the designated depth in the well. The setting tool adaptor 06 will pull the bottom sub 01 upwards, and at the same time, it will also push the mandrel 05 downwards, i.e., push the mandrel of the ball seat to move downwards, so as to make the mandrel 05 and the bottom sub 01 form the relative movement. The sealing element 04 and the baffle ring 03 will undergo elastic deformation due to extrusion; the sealing element of the first segment 041 will be extruded and cover on the transformational slope, which is situated on the external cylinder surface of the cylinder structure, and it will make the sealing element of the first segment 041 and the sealing element of the second segment 042 contact and seal the interior casing wall 07. The slips 02 will crack and be anchored into the interior casing wall. When the pushing force of the setting tool adaptor reaches the certain value, the setting tool adaptor 06 and the bottom sub 01 will detach via thread shearing. The setting tool adaptor 06 then can be retrieved, and since the bottom sub 01 is also made up of dissolvable material, so there will be no residues of such component left in the casing 07. At the same time, the slips 02 is anchored on the interior casing wall 07 via the frictional layer 021 and then the setting process is completed.

Figure 15:
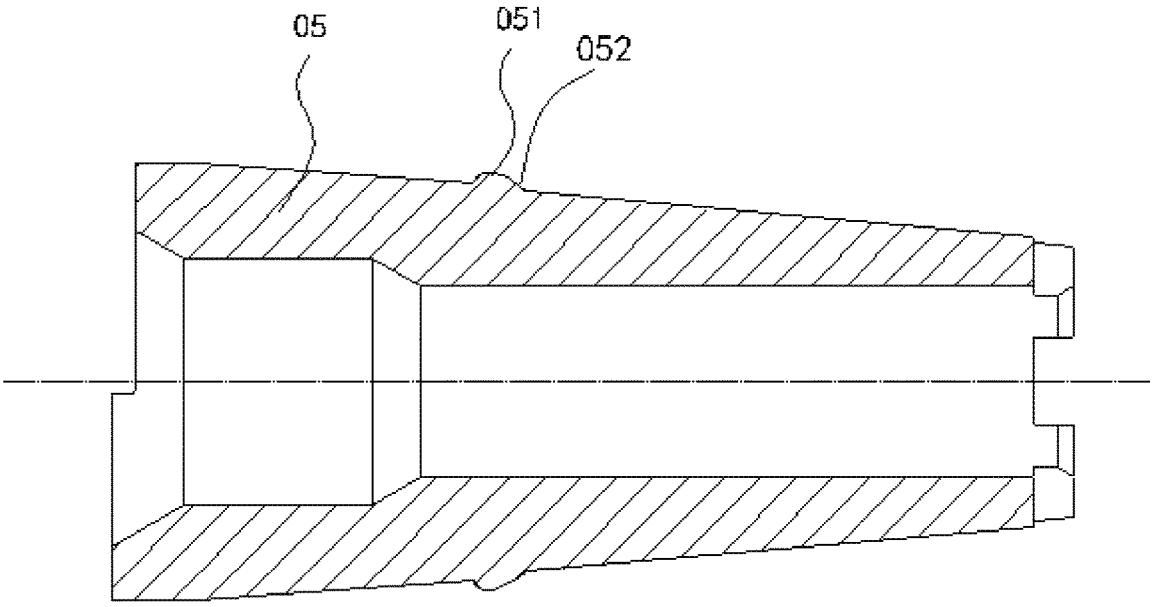
FIG. 15 is the structural diagram of another example of boss in this invention.
Figure 16:
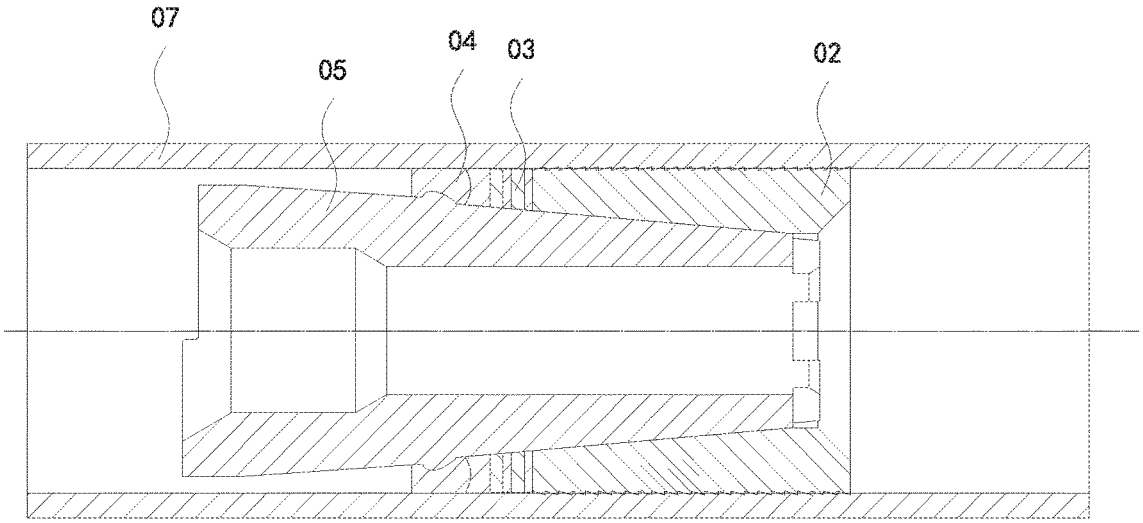
FIG. 16 the section view of the setting completed in the casing in another example of the invention.

In another example, the section view and the sketch of the external structure of the mandrel are shown in FIG. 15. The boss 051 is located on the mandrel 05, the boss 051 and the external surface of the mandrel 05 with smaller external diameter forms the transformational slope 052; when the seat ball is set, one end of the first segment of sealing element 041 is extruded and covers the transformational slope 051.

The section view of the completed ball seat setting in the casing 07 is shown in FIG. 14. During the setting process, by connecting the setting tool adaptor 06 with the bottom sub 01, the ball seat can be placed in the casing 07 and reach the designated depth in the well. The setting tool adaptor 06 will pull the bottom sub 01 upwards, and at the same time, it will also push the mandrel 05 downwards, i.e., push the mandrel of the ball seat to move downwards, so as to make the mandrel 05 and the bottom sub 01 form the relative movement. The sealing element 04 and the baffle ring 03 will undergo elastic deformation due to extrusion; the sealing element of the first segment 041 will be extruded and cover on the transformational slope, which is situated on the external cylinder surface of the cylinder structure, and it will make the sealing element of the first segment 041 and the sealing element of the second segment 042 contact and seal the interior casing wall 07. The slips 02 will crack and be anchored into the interior casing wall. When the pushing force of the setting tool adaptor reaches the certain value, the setting tool adaptor 06 and the bottom sub 01 will detach via thread shearing. The setting tool adaptor 06 then can be retrieved, and since the bottom sub 01 is also made up of dissolvable material, so there will be no residues of such component left in the casing 07. At the same time, the slips 02 is anchored on the interior casing wall 07 via the frictional layer 021 and then the setting process is completed.

In the description of this invention, what should be noted that, the terms "up", "down", "front", "rear", "left", "right", "in/within/inside" and "on/outside" refers to the direction and location relationship, which are based on the attached figures, they are only used to provide convenient for describing this invention, they don't indicate that the equipment or element must have such specified direction or the must of structured or to be operated in specified locations explicitly or implicitly, therefore, they should not be taken as the restriction to this invention. Besides, the terms such as "first" and "second" are also just for description, and they can be understood as instruction or implication of the relative importance.

In the description of this invention, what should be noted is that, the terms such as "install", "connect" and "link" should be understood generally, i.e, it might be fixed installation, detachable connection, integral connection or mechanical connection; it might be electrical connection, direct connection or indirect connection via the intermediate medium. For the common technicians in this field, they should understand the concrete meaning of these terms above used in this invention.

In order to make the purpose, technical plan and advantages of this invention more clear, the technical plan in the example of this invention will be described in a more clear and completed way along with the attached figures of this invention. Obviously, the described examples are only a partial of this invention. Based on the examples of this invention, all other examples obtained by the common technicians in this field without any creative/innovation work are protected by this invention.

The above examples of this invention are not to be used to restrict this invention. Any alteration, equivalent replacement and improvement made under the principles of this invention should also be protected by this invention.

The invention claimed is:

1. A ball seat configured for a multistage stimulation of oil and gas wells, comprising: a bottom sub, a plurality of slips, a sealing element and a mandrel;

wherein the mandrel has a shape of a cone frustum, and an end of the mandrel with a larger external diameter has a seat for ball landing and sealing, and the sealing element and the plurality of slips are muff-coupled on an exterior of the mandrel with a smaller external diameter, a first end of the sealing element is attached to a first end of each slip of the plurality of slips, and an end of the mandrel with the smaller external diameter is encased by the plurality of slips; a first end of the bottom sub is attached to a second end of each slip, a threaded shearing connecting structure is disposed in the bottom sub for a setting tool adaptor; the sealing element has a two-segment structure in an axial direction, a first segment of the sealing element is packed on the end of the mandrel with the larger external diameter, and a second segment of the sealing element is at the end of the mandrel with the smaller external diameter; a hardness of the first segment of the sealing element is lower than a hardness of the second segment of the sealing element, the first segment of the sealing element clamps with the second segment of the sealing element mutually, wherein a baffle ring is located between the sealing respectively, an internal diameter of the bathe ring matches with the external diameter of the mandrel, wherein the baffle ring comprises a multi-layer structure located in an axial direction.

2. The ball seat of claim 1, wherein a boss is located on a circumference of the mandrel with the larger external diameter, the boss and the exterior of the mandrel with the smaller external diameter form a transformational slope; after the ball seat is sealed, a first end of the first segment of the sealing element covers the transformational slope.

3. The ball seat of claim 2, wherein the boss extends to the end of the mandrel with the larger external diameter in an axial direction.

4. The ball seat of claim 3, wherein surfaces of the plurality of slips are made of multi-layered frictional structures.

5. The ball seat of claim 4, wherein a plurality of socket structures are arranged in an axial upward direction of each slip, and the plurality of sockets are distributed evenly on circumferences of the plurality of slips.

6. The ball seat of claim 5, wherein a Moh's hardness of each multi-layered frictional structure is larger than or equal to 3.

7. The ball seat of claim 6, wherein a ratio of a length of the sealing element in the axial direction to a length of each slip in an axial direction is 2:5 to 3:5.

8. The ball seat of claim 3, wherein the baffle ring is located between the sealing element and each slip, and an internal diameter of the baffle ring matches the external diameter of the mandrel.

9. The ball seat of claim 8 wherein an internal threaded structure is configured to connect the setting too adaptor.

10. The ball seat of claim 9, wherein the external diameter of the sealing element is larger than the external diameter of each slip.

11. The ball seat of claim 10, wherein a ratio of the external diameter of the sealing element to the external diameter of each slip is 1.04 to 1.08.

12. The ball seat of claim 11, wherein the plurality of slips, the bottom sub, the sealing element, the mandrel and the baffle ring are made of dissolvable materials.

13. The ball seat of claim 1, wherein an internal threaded structure is configured to connect the setting tool adaptor.

14. The ball seat of claim 13, wherein an external diameter of the sealing element is larger than an external diameter of each slip.

15. The ball seat of claim 14, wherein a ratio of the external diameter of the sealing element to the external diameter of each slip is 1.04 to 1.08.

16. The ball seat of claim 15, wherein the plurality of slips, the bottom sub, the sealing element, the mandrel and the baffle ring are made of dissolvable materials.

* * * * *